United States Patent [19]

Banks

[11] 4,238,244

[45] Dec. 9, 1980

[54] METHOD OF REMOVING DEPOSITS FROM SURFACES WITH A GAS AGITATED CLEANING LIQUID

[75] Inventor: William P. Banks, Duncan, Okla.

[73] Assignee: Halliburton Company, Duncan, Okla.

[21] Appl. No.: 950,192

[22] Filed: Oct. 10, 1978

[51] Int. Cl.[3] ..... B08B 3/10; B08B 9/00

[52] U.S. Cl. ..... 134/22 R; 134/34; 134/36

[58] Field of Search ..... 134/3, 34, 36, 42, 22 R; 252/157, 170; 424/43, 44, 45, 53

[56] References Cited

U.S. PATENT DOCUMENTS

| | | | |
|---|---|---|---|
| 975,814 | 11/1910 | Westlake | 424/53 |
| 1,534,167 | 4/1925 | Deavitt | 252/157 |
| 2,779,696 | 1/1957 | Rutherford | 134/22 C X |
| 3,037,887 | 6/1962 | Brenner et al. | 134/36 X |
| 3,050,422 | 8/1962 | Zak | 134/36 X |
| 3,326,606 | 6/1967 | Banks | 299/4 X |
| 3,357,923 | 12/1967 | Wool et al. | 252/157 |
| 3,436,262 | 4/1969 | Crowe et al. | 134/36 X |
| 3,506,582 | 4/1970 | Gertzman | 252/157 |
| 3,549,420 | 12/1970 | Cunningham | 134/34 X |
| 3,649,194 | 3/1972 | Glanville | 134/3 |
| 4,080,305 | 3/1978 | Holdt et al. | 252/157 X |
| 4,169,065 | 9/1979 | Robertson | 252/DIG. 14 X |

*Primary Examiner*—Marc L. Caroff

*Attorney, Agent, or Firm*—Thomas R. Weaver; John H. Tregonig; C. Clark Dougherty, Jr.

[57] ABSTRACT

Deposits are removed from surfaces by contacting the deposits with a deposit-removing liquid composition containing a substance which produces gas bubbles, and thereby stirs the liquid, at the conditions at which the deposits are contacted with the liquid. Where the substance is one which is a gas at atmospheric conditions but dissolves in the liquid at a super-atmospheric pressure, such as carbon dioxide, the pressure exerted on the composition while contacting the deposits is repeatedly raised and lowered whereby the gaseous substance is repeatedly liberated from solution and placed back into solution to promote agitation of the liquid.

2 Claims, No Drawings

METHOD OF REMOVING DEPOSITS FROM SURFACES WITH A GAS AGITATED CLEANING LIQUID

Liquid compositions for removing corrosion products and scales which are deposited on the interior surfaces of industrial apparatus, such as nuclear power plants and other industrial heat transfer equipment, are well-known and widely used. Such liquid compositions include, but are not limited to, chemicals which are solvents for the undesirable deposits to be removed, chemicals which react with the deposits to form insoluble precipitates which can be removed as dispersions in the spent solvents or in secondary treatments and chemicals which either are or act in conjunction with sequestering or chelating agents which remove all or portions of the deposits. Examples of such chemicals which have been used heretofore in deposit-removing liquid compositions are inorganic acids, organic acids, salts of such acids (particularly the alkali metal and ammonium salts) and inorganic and organic bases. Examples of specific solvents and chelants include hydochloric acid, phosphoric acid, sulfuric acid, citric acid, ethylenediaminetetraacetic acid, the phosphonic acids, formic acid, sodium hydroxide, ammonium hydroxide, triethanolamine, sulfamic acid, hydrofluoric acid and mixtures of two or more of such chemicals.

Corrosion products and scale deposits which are removable by liquid compositions of the type mentioned above include metal oxides such as iron oxide, copper oxide and others, spinels, metal sulfides such as iron sulfide, water scales such as gypsum and magnesium oxide and others.

In the use of liquid compositions for removing undesirable deposits from industrial apparatus, the liquid composition used is brought into contact with the deposits, either in a static condition or by circulating the liquid composition over surfaces in the apparatus containing the deposits, for a period of time sufficient to effect the removal of the deposits. It is well known by those skilled in the art that different contact conditions are required depending upon the particular liquid composition utilized and the particular deposits removed therewith. For example, certain deposits respond very satisfactorily to high pH compositions at low temperatures while others respond only to low pH compositions at high temperatures. Thus, depending upon the particular deposits to be removed, different compositions at varying concentrations, temperatures, pressures, pH and other conditions may be required.

A problem which is common to the removal of undesirable deposits from industrial equipment regardless of the particular deposit removed or deposit-removing liquid utilized is the lack of deposit contact with liquid which has not been spent. That is, as the deposit-removing liquid in contact with a deposit becomes spent or saturated with the dissolved or converted deposit, the rate of removal of the deposit decreases. While it is common practice to circulate the deposit-removing liquid through the apparatus containing the deposits to be removed, deposits which are located in areas within the apparatus over which the liquid cannot circulate, i.e., in stagnant areas, are not continuously contacted with fresh liquid. Once the liquid initially in contact with such deposits becomes spent or saturated, the rate of removal of the deposits is decreased in that fresh liquid which has not been spent does not readily displace the spent or saturated liquid. Thus, heretofore, in order to remove deposits in such stagnant areas, multistage treatments or prolonged treatments have been required.

By the present invention, improved methods of removing deposits from surfaces with deposit-removing liquids are provided which bring about the agitation or stirring of the deposit-removing liquid. Such agitation causes fresh liquid to displace spent or saturated liquid thereby increasing the efficiency and effectiveness of the deposit removal process.

The improved methods of this invention for removing deposits from surfaces with deposit-removing liquids comprise combining one or more chemicals with the liquids which produce gas bubbles in the liquids at the conditions at which the liquids are brought into contact with the deposits to be removed. The resulting deposit-removing liquid-chemical mixtures are brought into contact with the deposits and while such contact is carried out gas bubbles are formed in the liquids which agitate and stir the liquids to increase the contact of deposits thereby.

Chemicals which are suitable for use in accordance with the present invention to produce gas bubbles in deposit-removing liquids include volatile substances which are in the liquid phase at atmospheric conditions and in the gaseous phase at the conditions at which the deposit-removing liquid-chemical mixture is brought into contact with the deposits such as methyl alcohol, ethyl alcohol, propyl alcohol and other organic volatile materials; substances which are in the gaseous phase at atmospheric conditions and in the liquid phase at super-atmospheric pressure conditions such as methane ethane, propane, butane and the like; substances which are in the gaseous phase at atmospheric conditions and at the conditions at which the deposit-removing liquids are to be brought into contact with the deposits but which can be dissolved in the deposit-removing liquids, e.g., carbon dioxide and nitrogen; and substances which decompose or react to form a gas at the conditions at which the deposits are to be contacted such as hydrogen peroxide. The term "atmospheric conditions" is used herein to mean the range of atmospheric pressure and temperature conditions encountered throughout the world. The term "super-atmoshperic pressure condition" is used herein to mean pressure levels above atmospheric pressure up to about 1500 psig at temperatures in the range of from atmospheric to about 350° F.

In the use of volatile gas forming substances which are in the liquid phase at atmospheric conditions and in the gaseous phase at conditions at which the deposit-removing liquid-chemical mixtures is brought into contact with the deposits, e.g., ethyl alcohol, the gas forming substance is combined with the deposit-removing liquid utilized at atmospheric conditions. The resulting mixture is introduced into or through the apparatus and/or onto or over the surfaces containing deposits to be removed and the temperature of the mixture is raised so that the volatile substance is vaporized. The vaporization of the volatile substance forms bubbles in the deposit-removing liquid as it contacts the deposits causing the liquid to be agitated and stirred and spent liquid to be displaced by fresh liquid. Preferably, the deposit-removing liquid-volatile substance mixture is circulated into contact with the deposits for an initial period of time before the temperature of the mixture is raised to vaporize the volatile substance. This allows the deposit-removing liquid in contact with the deposits to become spent or saturated before being displaced with fresh liquid.

In a more preferred embodiment of the method of the present invention, the deposit-removing liquid-volatile substance mixture is circulated into contact with the deposit for an initial period of time at atmospheric conditions whereby the volatile substance remains in the liquid phase while portions of the deposit-removing liquid become spent. The temperature of the mixture is then raised while contacting the deposits whereby the volatile substance is vaporized and gas bubbles formed in the mixture to cause displacement of spent liquid with fresh liquid. The pressure exerted on the mixture can then be raised to a super-atmospheric pressure level such that the volatile substance is condensed followed by repeated lowering and raising of the pressure exerted on the mixture so that the volatile substance is repeatedly condensed and vaporized and the mixture agitated by gas bubbles formed therein until the deposits are removed.

In use of substances which are in the gaseous phase at atmospheric conditions and in the liquid phase at super-atmospheric pressure conditions, e.g., propane, the deposit-removing liquid is circulated or otherwise introduced into or through the apparatus and/or onto or over the surfaces containing deposits to be removed, and the temperature of the liquid is raised to the desired contact temperature. The pressure exerted on the liquid is next raised to a super-atmospheric pressure level such that at the temperature and super-atmospheric pressure of the liquid, the gas-forming substance to be used will remain in the liquid phase. The gas-forming substance is then combined with the deposit-removing liquid, and the mixture is allowed to contact the deposit for an initial period of time. The pressure exerted on the mixture is next lowered so that the gas-forming substance is vaporized and forms bubbles in the liquid whereby the liquid is agitated and stirred. The pressure exerted on the mixture can then be repeatedly raised and lowered to vaporize and condense the gas-forming substance and repeatedly agitate the mixture.

In use of substances which are in the gaseous phase at both atmospheric conditions and at the conditions at which the deposit-removing liquid is to be brought into contact with the deposit but which can be dissolved in the deposit-removing liquid, e.g., carbon dioxide, the deposit-removing liquid to be utilized is brought up to the desired temperature and the soluble gas utilized is dissolved therein at a super-atmospheric pressure. The resulting solution is then introduced into or through the apparatus or otherwise onto or over the surfaces containing the deposit to be removed at the super-atmospheric pressure at which the gas was dissolved for an initial period of time. The pressure exerted on the solution is then lowered so that the dissolved gas is liberated from the solution and the solution agitated. The pressure exerted on the solution can then be repeatedly increased and decreased to place the gas back into solution and liberate it therefrom to repeatedly agitate the solution during the deposit-removing process.

In use of substances which decompose or react to form a gas at the conditions at which the deposits are to be contacted, e.g., hydrogen peroxide, the gas-forming substance used is combined with the deposit-removing liquid used at atmospheric conditions and the resulting mixture is brought up to the temperature and pressure desired while the deposits to be removed are contacted therewith. The gas-forming substance reacts or decomposes to form a gas and continuously agitate the mixture during the contact.

As will be understood, the particular gas-forming substance utilized should be selected whereby the substance does not significantly adversely react with the liquid deposit-removing composition used or otherwise interfere with the deposit removal process. While various concentrations of gas-forming substance can be utilized, concentrations in the range of from about 0.1% to about 5% by weight of deposit-removing liquid have been found to be effective.

Of the various gas-forming substances described above which can be utilized in accordance with the methods of this invention, carbon dioxide and hydrogen peroxide are preferred. Carbon dioxide is readily dissolved in most of the deposit-removing liquid compositions utilized and is nonreactive therewith as well as incombustible. The use of hydrogen peroxide as the gas-forming substance in accordance with the methods of the present invention is particularly advantageous in that it slowly and continuously decomposes to form oxygen and water thereby continuously forming gas bubbles in the depost-removing liquid and agitating the liquid. In addition, the oxygen formed promotes the oxidation of deposits containing iron and other metals and thereby facilitates the removal thereof. Preferably, the hydrogen peroxide is combined with the deposit-removing liquid utilized in an amount in the range of from about 0.1% to about 5% by weight of the liquid.

As will be understood by those skilled in the art, one or more gas-forming substances of the type described herein can be utilized in a deposit-removing liquid to form gas bubbles therein and agitate the liquid while the deposits to be removed are contacted to that the contact between the deposits and liquid which has not been spent or saturated is increased. This in turn increases the efficiency of the deposit removal process making it more economical to carry out as compared to processes utilized heretofore. The particular gas-forming substance utilized will vary depending upon the particular makeup of the deposits to be removed as well as the deposit-removing liquid to be used, the conditions of contact with the deposits required, etc. to achieve the best results.

In order to further illustrate the present invention, the following examples are given.

EXAMPLE 1

In the laboratory, 100 milliliters of deionized water are placed in a visual pressure cell and the water is saturated with nitrogen gas at a temperature of 75° F. and 500 psig. The pressure exerted on the cell is decreased rapidly and the formation of nitrogen gas bubbles in the water is observed. The gas bubbles rise upwardly and stir the water.

EXAMPLE 2

100 milliliters of deionized water are placed in a visual pressure cell and saturated with carbon dioxide gas at 75° F. and 100 psig. The pressure exerted on the cell is decreased rapidly and the formation of carbon dioxide gas bubbles which agitate the water is observed.

EXAMPLE 3

100 milliliters of a 5% by weight citric acid solution ammoniated with ammonium hydroxide to a pH of about 3.5 are placed in a visual pressure cell and saturated with carbon dioxide gas at 75° F. and 100 psig.

The pressure exerted on the cell is decreased rapidly and the formation of large numbers of carbon dioxide gas bubbles which agitate the solution is observed.

EXAMPLE 4

100 milliliters of an aqueous solution containing 3% by weight hydrogen peroxide at a temperature of 75° F. are placed in a glass beaker. Approximately 0.2 grams of powdered ferrous ammonium sulfate (to simulate iron compound deposits) are added to the hydrogen peroxide solution. The hydrogen peroxide decomposes to form oxygen gas bubbles in the solution for a period of time over one hour. As the oxygen is formed in the solution the gas bubbles agitate and stir the solution.

EXAMPLE 5

100 milliliters of an aqueous solution containing 3% by weight hydrogen peroxide are placed in a visual pressure cell. About 0.2 grams of powdered ferrous ammonium sulfate are added to the solution and the cell is sealed at atmospheric pressure. Oxygen gas bubbles are formed in the solution which rise upwardly and stir the solution. The pressure in the cell increases from atmospheric pressure to 100 psig during a 30 minute time period. The pressure exerted on the cell is reduced to atmospheric pressure and additional oxygen bubble formation and stirring of the solvent are observed. In addition, oxygen bubbles are observed clinging to solid particles of ferrous ammonium sulfate causing the particles to rise upwardly through the solution.

What is claimed is:

1. In the method of removing deposits of corrosion products and scale from the interior surfaces of heat transfer equipment comprising contacting said deposits with a liquid composition capable of removing said deposits under appropriate contact conditions of pH, temperature, concentration and pressure for a period of time sufficient to remove said deposits, the improvement which consists essentially of:

(a) forming a liquid mixture by combining with said liquid composition by dissolution therein at a super-atmospheric pressure a chemical which is a gas at atmospheric conditions and which produces a gas in said liquid composition at a reduced pressure level at said appropriate contact conditions;

(b) contacting said deposits with said liquid mixture for a period of time at said super-atmospheric pressure whereby at least a portion of said chemical dissolved in said liquid composition remains in solution followed by a period of time at said reduced pressure level at said appropriate contact conditions whereby at least a portion of said chemical produces said gas which is liberated from solution and forms bubbles which agitate said liquid composition to thereby improve said contacting of said deposits by said liquid composition;

(c) raising the pressure exerted on said liquid mixture to said super-atmospheric pressure whereby said chemical is placed back into solution; and (d) repeating said steps (b) and (c) whereby said chemical is repeatedly liberated from solution and placed back into solution.

2. In the method of removing deposits of corrosion products and scale from the interior surfaces of heat transfer equipment comprising contacting said deposits with a liquid composition capable of removing said deposits for a period of time sufficient to effect the removal thereof, the improvement which comprises:

dissolving carbon dioxide in said liquid composition at a super-atmospheric pressure to form a solution;

contacting said deposits with said solution at said super-atmospheric pressure for an initial period of time;

contacting said deposits with said solution for an additional period of time at a reduced pressure whereby carbon dioxide is liberated from said solution and said solution is agitated during said contacting; and repeatedly raising and lowering the pressure exerted on said solution while contacting said deposits with said solution whereby carbon dioxide is repeatedly placed in said solution and liberated therefrom and said solution is repeatedly agitated during said contact.

* * * * *